United States Patent [19]

Meyer et al.

[11] Patent Number: 4,598,944

[45] Date of Patent: Jul. 8, 1986

[54] HAND GRIP CONTROLLED, USER ASSISTED RAISING CHAIR

[75] Inventors: Bruno Meyer, Wohlen; Peter Nold, Wettingen, both of Switzerland

[73] Assignee: Valutec AG, Dottikon, Switzerland

[21] Appl. No.: 718,079

[22] Filed: Apr. 1, 1985

[30] Foreign Application Priority Data

Apr. 6, 1984 [CH] Switzerland ..... 1744/84

[51] Int. Cl.[4] ..... A47C 4/52

[52] U.S. Cl. ..... 297/183; 280/289 WC; 297/338; 297/339; 297/411; 297/DIG. 10; 297/DIG. 4

[58] Field of Search ..... 297/DIG. 10, 183, 417, 297/411, 338, 339, DIG. 4; 280/289 WC; 180/11

[56] References Cited

U.S. PATENT DOCUMENTS

| | | | |
|---|---|---|---|
| 3,759,544 | 9/1973 | Korpela | 297/DIG. 10 |
| 4,067,249 | 1/1978 | Deucher | 297/330 |
| 4,076,304 | 2/1978 | Deucher | 297/45 |

FOREIGN PATENT DOCUMENTS

| | | | |
|---|---|---|---|
| 494034 | 1/1978 | Australia | 297/DIG. 10 |
| 473579 | 7/1969 | Switzerland | 280/289 WC |
| 553573 | 9/1974 | Switzerland . | |
| 632153 | 9/1982 | Switzerland | 297/DIG. 10 |
| 1407033 | 9/1975 | United Kingdom | 297/DIG. 10 |

*Primary Examiner*—James T. McCall

*Attorney, Agent, or Firm*—Frishauf, Holtz, Goodman & Woodward

[57] ABSTRACT

The raising wheel chair substantially comprises the frame (11), wheels (13 and 15) and the seat (17) pivotably connected to the frame (11). A footrest (21) at the front and a backrest (19) at the back are pivotably connected to the seat (17). For raising the user into an upright position, a spring (27) applies a force which acts counter to the weight of the user, so as to facilitate raising the user to an erect position. A support arm (37) which can be arrested in various positions is pivotably connected to the pivot axis on both sides of the frame (11). To arrest the support arm, the locking lever (41) has a multiplicity of locking positions (45), which can be engaged by a locking element (47). The arm (37) can be put into a horizontal position, in which it offers no hindrance to the user in performing a lateral transfer movement, for instance to shift to a toilet seat.

25 Claims, 11 Drawing Figures

HAND GRIP CONTROLLED, USER ASSISTED RAISING CHAIR

Reference to related patents, the disclosure of which is hereby incorporated by reference: U.S. Pat. Nos. 4,067,249, Deucher, and 4,076,304, Deucher.

Reference to related disclosure: German Patent Disclosure document DE-OS No. 23 62 029 (to which Swiss No. 553,573 corresponds); DE-OS No. 33 10 429.

The present invention relates to a raising chair, and more particularly to a raising chair which can be constructed, for example, as a foldable or collapsible raising wheelchair, having a seat and spring elements which assist a patient in raising himself from a seated to an upright position, the seat and backrest moving together with the user to support the user in her/his movement as the user rises from a seated position.

BACKGROUND

Raising chairs are known; see the referenced U.S. Pat. Nos. 4,062,249 and 4,076,304, for example. A spring, or other similar device is provided in order to move the seat and/or backrest to follow the movement of a user, if the user wishes to rise from a seated to an erect position. The spring assists in lifting the user, and counteracts the weight of the user to help the user in rising from a seated to an erect position. The user, of course, must have a handle or other support on which the user can support her/himself upon rising, that is, brace her/himself. Such bracing also reduces the force necessarily exerted by the spring, or similar force-exerting structure, for example a counterweight, in order to reduce the force necessarily acting on the seat when the user changes from a seated to an erect position.

The German Patent Disclosure Document DE-OS No. 23 62 029 describes an adjustment arrangement to tilt the seat in a raising chair. The adjustment and force supply apparatus comprises two main gas springs, each attached to an end of the seat with one end portion and to a support frame with the other. The gas springs can be locked in an extended, or compressed position by locking elements which are controlled by hand levers and Bowden cables, similar to bicycle hand brake handles. The hand levers are attached to handle elements, which, again, may be similar to the end portions of bicycle handle bars, the handles being attached to the frame by suitable connecting elements, such as tubing.

In order to rise to an upright position with this raising chair, the user releases the locking of the main springs and perhaps also leans forward slightly. The user can hold onto two hand grips attached at the front to two vertical tubes extending across the seating surface and pull himself forward somewhat. The seat is pivoted upward, about its front edge, by the spring force and the user is brought to a standing position. In addition to the main springs, an auxiliary spring contributes to this pivoting movement. Now if the user wishes to return to the seated position from this standing position, he pivots a hand lever, which relaxes the auxiliary spring. The main springs are then compressed once again by the body weight of the user, so that the seat returns to the seating position, and once the proper lever grip has been released the seat is locked in this position. By pivoting an actuation lever forward, the user can prestress the auxiliary spring once again, thereby making its additional force available again for subsequently raising the user to an erect position.

This type of raising chair is relatively complicated and expensive to manufacture. A particular disadvantage is also that the hand grips are disposed at the front of the chair and thereby prevent the user from making a lateral transfer movement, such as may be desired, for instance, to shift to a toilet seat. Furthermore, the hand grip is in an unfavorable position during the erecting operation, so that with such a chair, the user can rise to a standing position only by exerting great force, if at all. For these reasons, a chair of this kind has not met with commercial success.

THE INVENTION

It is the object of the present invention to improve a raising chair, in particular a collapsible raising wheel chair. The hand grips should not hinder lateral transfer movement by the seated user. Furthermore, the hand grips should to be disposed correctly, from an ergonomic standpoint, in every position, so that the user can rise to a standing position without exerting great force. A further object is that additional expensive mechanisms and gas springs not be required.

Briefly, a continuously variable adjustment, or positioning, means is provided, in order to adjust the height of the hand grips at a first, lower position. This has the advantage over the chair according to the prior art that, in order to rise to a standing position, the user can put the hand grips into a position in which he can initiate a raising movement with the least possible effort. Experiments have shown that the best position of the hand grips, at the beginning of the raising operation, is in the vicinity of the user, so that the user need only press downward in order to initiate a raising movement.

If the user then moves a short distance upward and forward, then the hand grips, in their initial position, are too low and too far to the rear. In accordance with a feature of the invention, the hand grips are adjustable. After having moved some distance upward toward an upright position, the user can put the hand grips into some other position in which they are again located comfortably for her or him, and to continue the erecting operation she or he can exert further force on the hand grips without great effort.

Conversely, when moving to a seated position the user can return the hand grips to a lower position, where they can also be used as armrests. In accordance with another feature of the invention, it is also possible for the hand grips to be lowered so far that they present no hindrance at all to a lateral transfer movement.

The adjustment, or positioning, means is suitably embodied by a support arm which carries the hand grip, is pivotably connected to the chair frame, and can be selectively locked in position at various heights. This results in a particularly simple and inexpensive embodiment. The support arm can advantageously be lowered into a position below the level at which the chair seat is located when in the sitting position. This assures that the hand grips can be lowered in such a way that they do not prevent the user from shifting laterally, for instance for use of a toilet.

It is particularly advantageous if each support arm is pivotably connected to the front of the chair frame. The arm can then have the same axis of rotation as the seat. As a result, the hand grips are in a comfortable position for the user no matter what the position of the raising chair at a given time. Just as the seat of the raising chair can be moved upward and forward when the user is rising to an upright position, so the hand grips can also be moved upward and forward. They are therefore always located in an ergonomically favorable position. However, it would also be possible to connect the support arm pivotably to the back of the chair frame, which has the advantage that a transfer movement by the user would also be possible in the upright position.

An advantageous embodiment of the invention provides that a locking lever is pivotably connected to the support arm, spaced apart from the pivot arm axis of rotation. The locking lever has a multiplicity of engagement, or locking positions, which can be engaged by a locking element disposed on the chair frame. The locking lever is advantageously double-armed, one arm having the locking positions and the other arm having a handle for use in unlocking. As a result, the adjustment means is of particularly simple construction.

A particularly significant feature is that each of the hand grips, of which there is at least one, is pivotable about a predetermined range, which is advantageous since a raising wheel chair must satisfy contradicting requirements.

On the one hand, such a chair must not exceed a certain standard width, because otherwise there are problems with narrow doors; on the other hand, the seat should be sufficiently wide that the user is comfortable. This means, however, that there is only a very narrow space between the rear wheels and the space occupied by the seat as it moves. In order to permit a lateral transfer, the hand grip must be capable of being lowered into this narrow space.

The pivotable embodiment of the hand grip according to the invention makes this possible without necessitating any decrease in the usual seat width. It is in fact sufficient for the hand grips to be lowered by being pivoted inward in the vicinity of the wheels. In the chair according to the state of the art (see Background above), a reduction of the seat width was avoidable only by attaching the hand grips in a stationary manner to the front of the chair. This made it impossible, however, for the user to shift himself laterally from the chair. Furthermore, the stationary disposition has the above-mentioned disadvantage that it requires the user to exert great force in order to perform a raising operation.

A suitable feature of the invention provides that the support arms have have a locking latch, which normally engages a ratchet wheel or ratchet wheel segment fixed to the frame but which can be released manually. This construction also provides a relatively inexpensive adjustment means. However, the adjustment means can also be embodied as a telescopically adjustable column supported on the frame. This construction has the advantage that it does not require any pivotable hand grips.

It is also possible, however, for the column also to be pivotable and for it to be lockagle selectively in various positions. The pivot point is advantageously at the front or back on the chair frame.

It would also be possible for only one hand grip to be provided. It has proved preferably, however, for one hand grip to be provided on each side of the seat.

DRAWINGS

Figure 4:
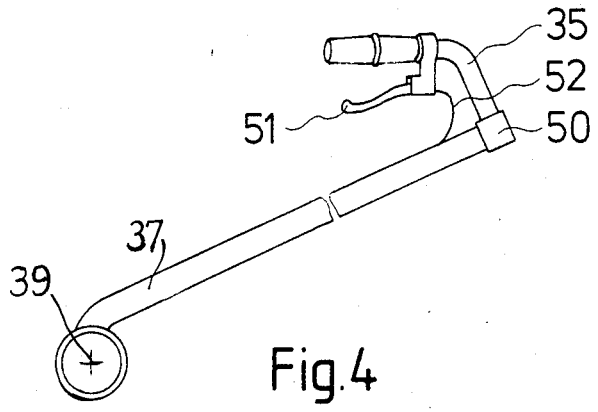
FIG. 4 shows a hand grip and the support arm, seen from the side.
Figure 4A:
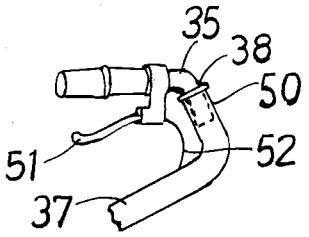
Figure 5:
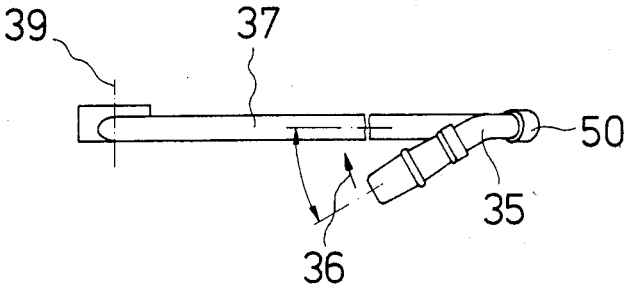
Figure 6:
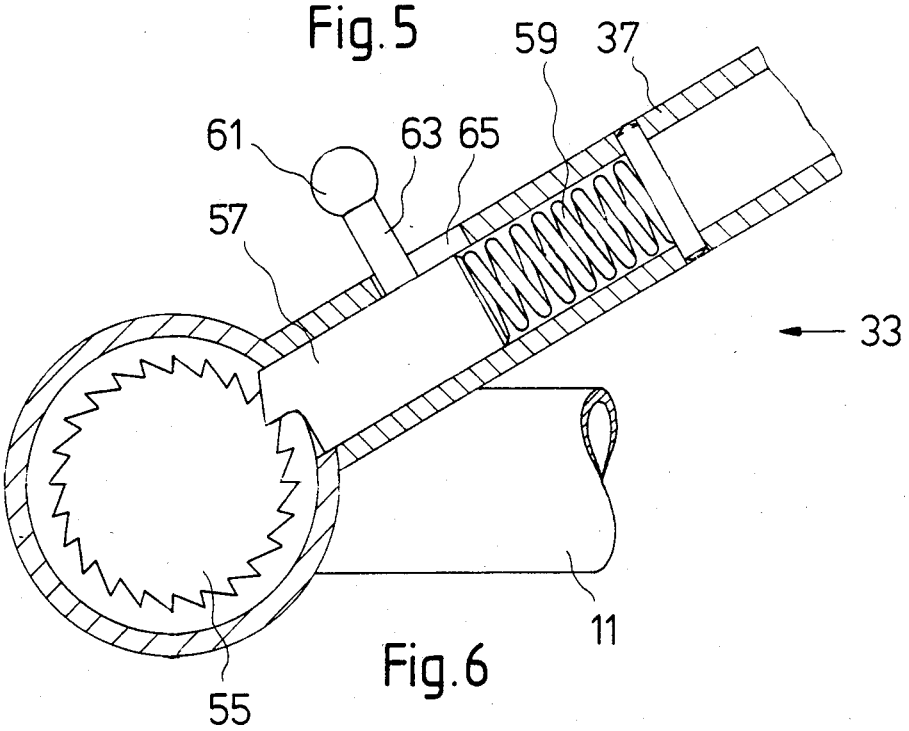
Figure 7:
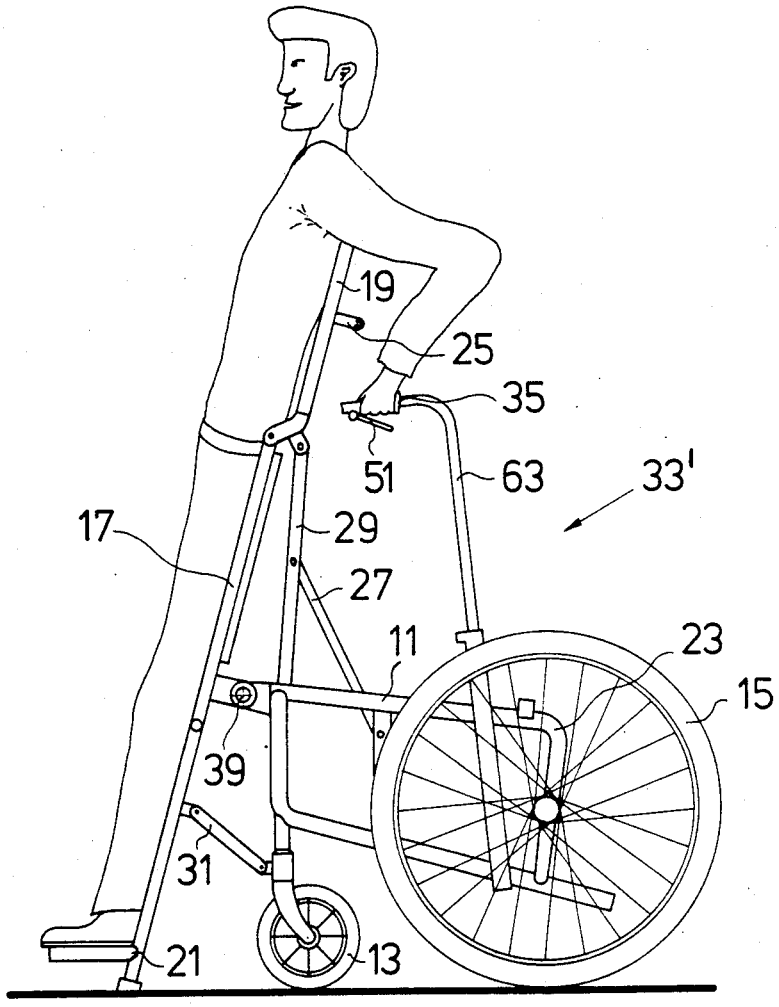
Figure 8:
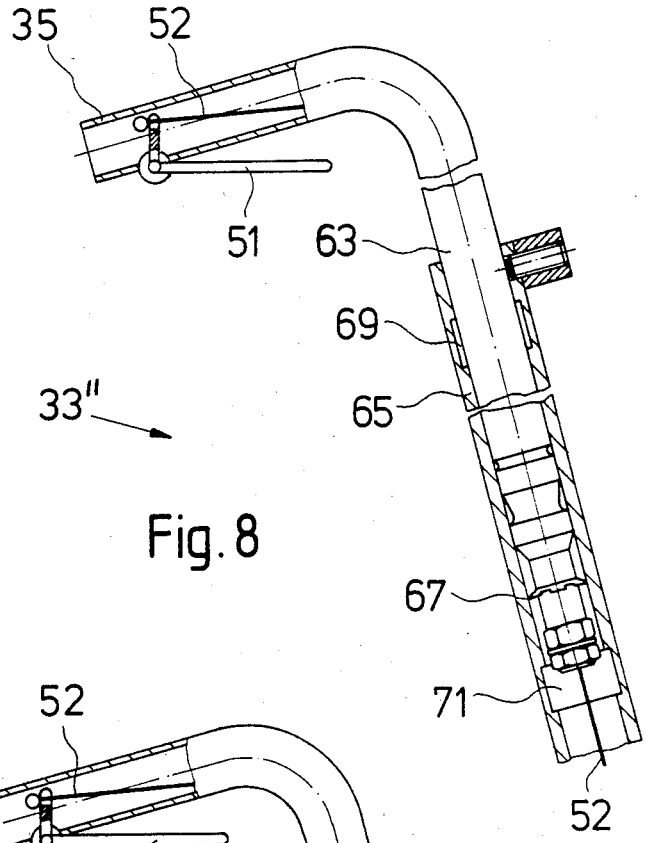
Figure 10:
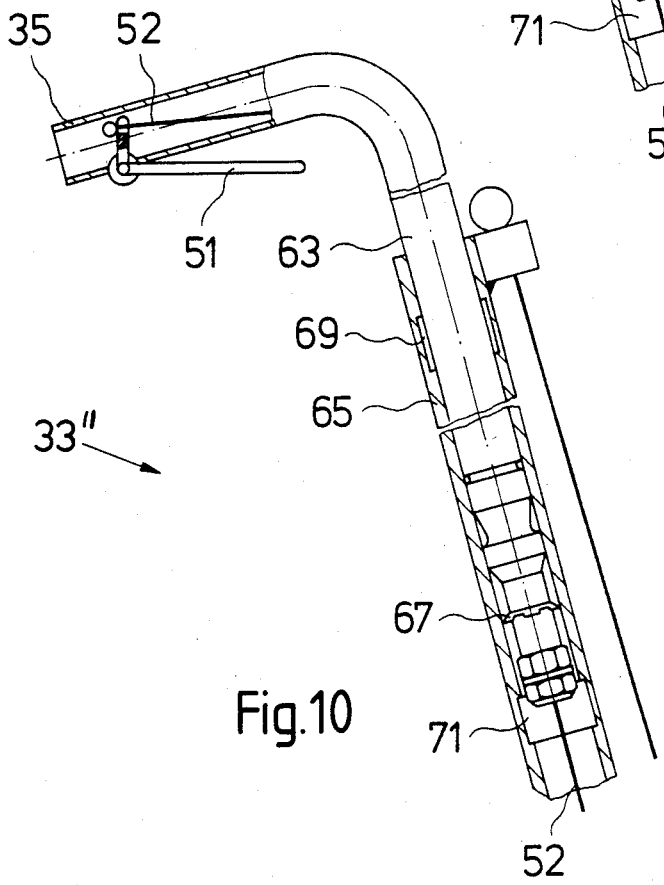
Figure 9:
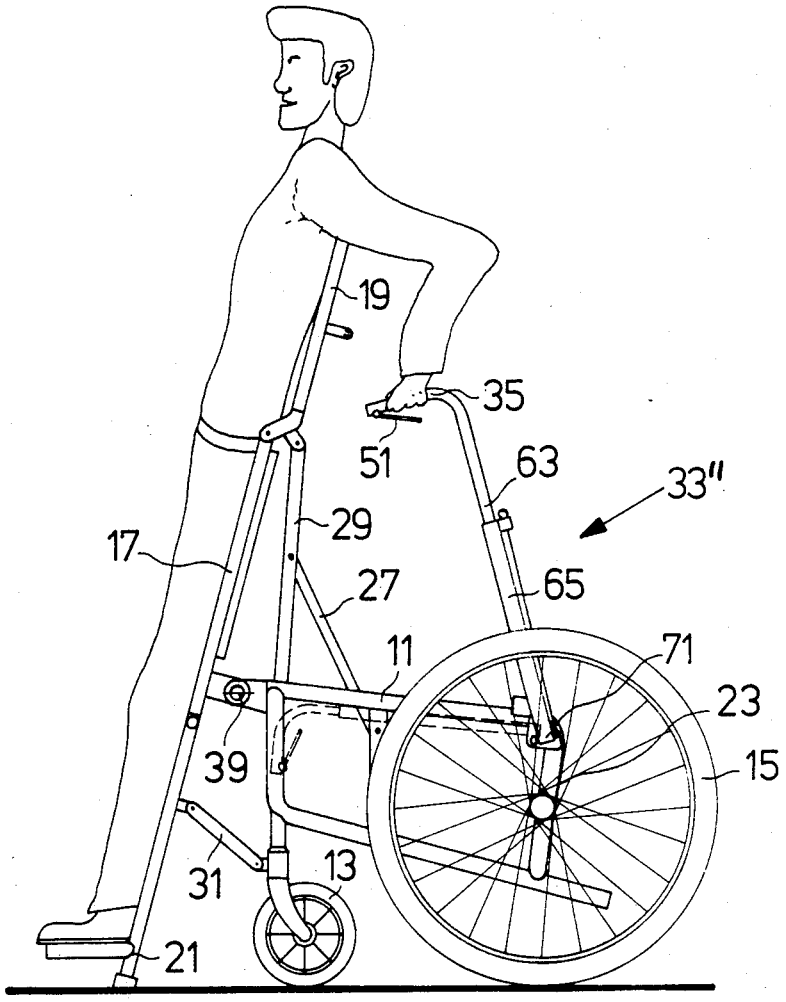

FIG. 4*a* shows a particularly advantageous embodiment of the support of the hand grip in the support arm;

FIG. 5 shows the hand grip and support arm, seen from above;

FIG. 6 shows an exemplary embodiment of the adjustment means for the support arm;

FIG. 7 shows a further exemplary embodiment of a raising chair, having a different adjustment means for the hand grip;

FIG. 8 is a more detailed view of the adjustment means of FIG. 7;

FIG. 9 shows a further exemplary embodiment of a raising chair having an adjustment means similar to FIG. 7; and FIG. 10 is a more detailed view of the adjustment means of FIG. 8.

DETAILED DESCRIPTION

Figure 1:
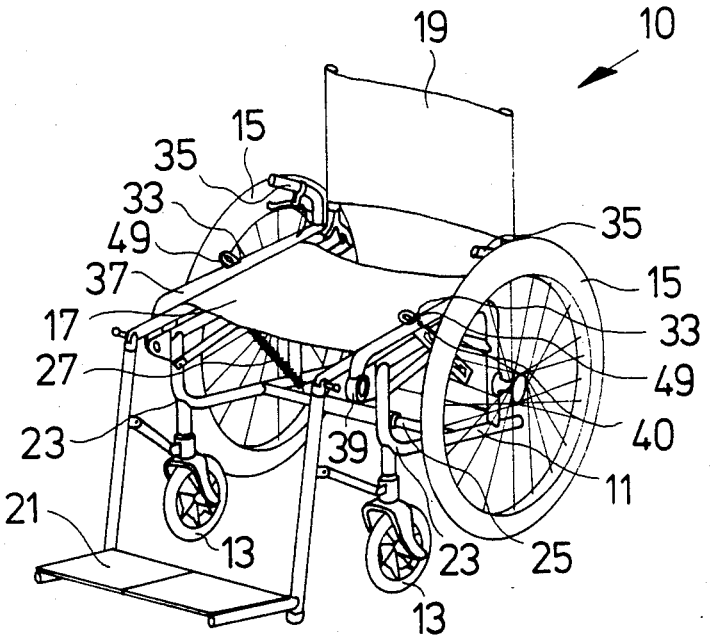
FIG. 1 is a perspective illustration of a first exemplary embodiment of the raising chair according to the invention.
Figure 2:
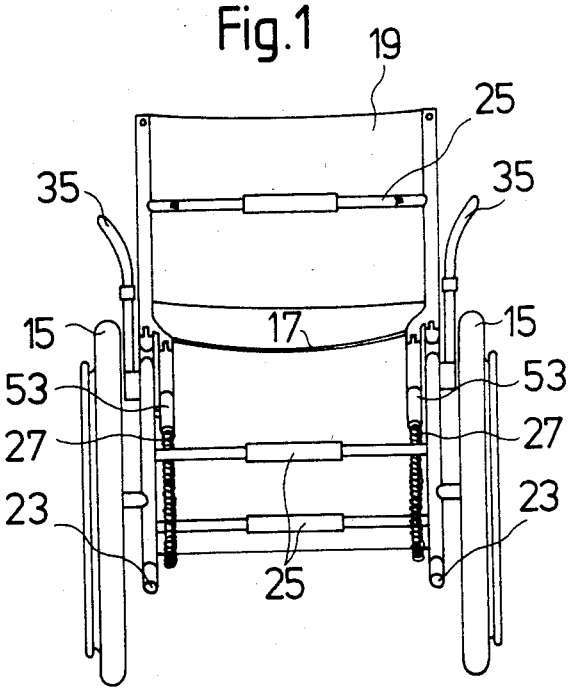
FIG. 2 shows the raising chair of FIG. 1, seen from behind.
Figure 3:
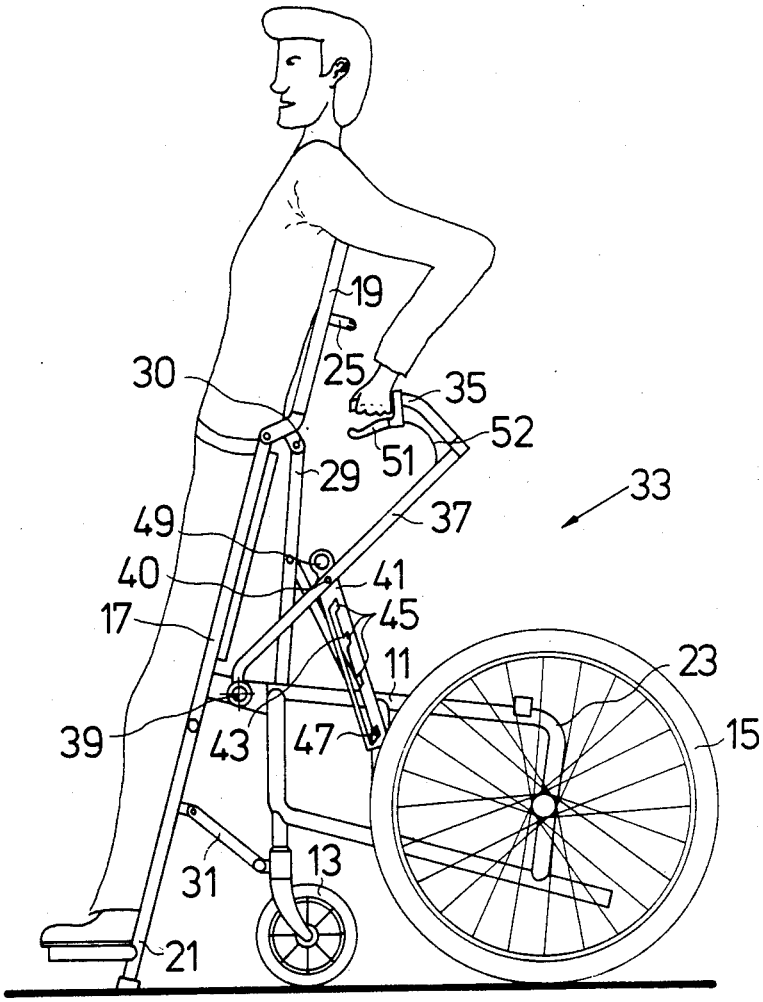
FIG. 3 shows the raising chair of FIG. 1 at the end of the raising operation.

The collapsible raising chair 10 shown in FIGS. 1–3, in the conventional manner, comprises a frame 11, a pair of front wheels 13 and a pair of rear wheels 15, a seat 17 pivotably connected to the frame 11, a backrest 19 pivotably connected to the seat 17 and a footrest 21 pivotably connected to the front of the seat 17.

The chair frame 11 comprises two side frames 23, which are connected to one another by means of two collapsible cross braces 25. A further brace 25 is provided for the backrest 19.

The raising or erecting movement out of the position shown in FIG. 1 and into the position shown in FIG. 3 is reinforced by two springs 27. During the erecting operation, these springs 27 exert a force upon the seat 17 which counteracts the weight of the user. A parallelogram rod 29 (FIG. 3), which is rotatably fixed with one end to the frame 11 and with the other end to a pivotable connection point 30 of the backrest 19, assures that in every position of the chair the backrest assumes practically the same position. Similarly, the connecting lever 31 assures the stabilization of the footrest 21.

In accordance with the invention, a positioning, or adjustment, arrangement 33 is provided, located on at least one and preferably both sides of the chair. With this arrangement 33, the at least one hand grip 35 can be moved to positions at various heights. This enables the user to move the hand grips 35 to a height suitable for her or his own position, a height at which he can readily be supported on these hand grips 35, in order to raise her/himself further into the upright position.

As shown in FIG. 1, however, the hand grips 35 can also be moved into a lower position in which they are in the vicinity of the rear wheels. In this position, there are no hindrances to a lateral transfer movement on the part of the user, such as may be desired, for instance, to shift over to a toilet seat.

Closer examination of the adjustment means 33 shows that it is pivotably connected to the frame 11 on the same axis of rotation, or pivot point, 39 as the seat 17. This pivotable connection on the front of the seat enables the lowering, shown in FIG. 1, of the support arms 37 along with the hand grips 35 into a position in which they do not hinder a transfer movement.

As shown particularly in FIG. 3, a locking lever 41 is pivotably connected to the support arm 37 at 40, spaced apart from the pivot point 39. The locking lever 41 has a slit 43 with four engagement, or locking positions 45, which a locking element 47 disposed on the frame 11 is capable of engaging. The locking lever 41 is double-armed, the upper arm 49 forming a handle for unlocking the locking lever. If the chair user wishes to lower the hand grip 35, she or he presses the locking lever handle 49 forward, unlatching the locking element 47, so that the hand grip 35 can be pushed into the position shown in FIG. 1.

FIGS. 2, 4 and 5 show the hand grips 35 in a position in which they are pivoted outward. Since the space between the rear wheels 15 and the seat 17 is restricted, the hand grips 35 are pivotable in the direction of the arrow 36 (FIG. 5) to such an extent that they can be located in the same vertical plane as the support arms 37. In this location, there is room for the hand grips 35 even in the position shown in FIG. 1.

After the hand grips 35 have been pivoted outward into the operating position shown in FIG. 2, sufficient space still remains between the user's fingers and the seat 17 for the user to move up or down, past the hand grips 35.

In the embodiment shown in FIG. 4*a*, the support arm 37 is a tubular element. The hand grip 35 has an extension 38 which extends engagingly into the free end of the tubular element and is rotatable therein to a predetermined extent.

As also shown in FIGS. 1 and 4, an actuating lever 51 which is readily reachable by the user's fingers is located on the hand grip 35, being connected via a Bowden cable 52 to a locking device 53 (FIG. 2) for the seat 17. In the unactuated position of the lever 51, the seat 17 remains locked in a given position.

Operation; rising, and raising the seat (FIG. 1 to FIG. 3)

When the user of the raising chair wishes to rise from the seated position shown in FIG. 1 to the upright position shown in FIG. 3, then she or he raises the hand grips 35 slightly and then supports her/himself on them. The hand grips 35 then pivot, by rotation in the bushing or sleeve 50, into the final position shown in FIGS. 2 and 5. The locking element 47 also engages a locking position 45 of the locking lever 41. Now if the user unlocks the seat by actuating the actuating lever 51 and supports her/himself on the hand grips 35, then she or he is capable of moving upward with little expenditure of force, with the aid of the springs 27. The user then releases the actuating lever 51 and pulls the hand grips 35 farther upward, until the locking elements 47 engage a different locking position. The user then actuates the actuating lever 51 once again and moves her/himself farther upward using the arm muscles, until she or he has attained the desired position.

Sitting down and lowering the seat (FIG. 3 to FIG. 1)

In order to lower the chair, the user actuates the actuating lever 51, whereupon the seat 17 moves downward, under the weight of the user. By moving the locking element handles 49 forward, the locking lever 41 can be released and the hand grips 35 lowered.

FIG. 6 shows a different embodiment of the adjustment arrangement 33. A ratchet wheel 55 or ratchet segment is firmly attached to the frame 11 and is engageable by a locking latch 57 movably disposed on the support arm 37. If the support arm 37 is moved upward, then a downward movement is blocked by the latch 57. In order to release the latch, however, it may be moved upward, counter to the force of a spring 59, with the knob 61, which can be remotely operated, e.g. by a Bowden cable. If desired, an arm 63 can be moved crosswise into a slit 65 and arrested there.

FIG. 7 shows a raising chair like that of FIG. 3, but having a different adjustment arrangement 33'. In this adjustment means 33', the at least one hand grip 35 is disposed on a telescopically extendable column 63 supported on the frame 11. The hand grip 35 can be pulled up into any desired position, in which case a holding mechanism prevents the column 63 from sliding downward. If the column 63 is extended into the upper terminal position, however, then it can be returned to the lower terminal position by exerting a slight pressure. The mechanism used for this purpose is shown in FIG. 8. The column 63 having the hand grip 35 and the actuating lever 51 is displaceable in the tube 65. A conical, or bulged, or bowed disk spring 67 effects firm clamping, whenever a force is exerted downward upon the hand grip 35. The hand grip 35 can still be pulled farther upward, however. If the disk spring 67 reaches the space 69, and the hand grip 35 is then pressed downward, then the disk spring snaps over to bulge in the other direction, and the hand grip 35 can be moved effortlessly downward. If the disk spring 67 reaches the space 71, then when the column 63 is pulled out, the disk spring is snapped back into the position shown in FIG. 8, and in this position it counteracts any downward movement of the column 63. FIG. 8 shows the arrangement in the collapsing, or depressing position.

The exemplary embodiment of a raising chair shown in FIGS. 9 and 10 differs from that of FIGS. 7 and 8 in that, in the adjustment arrangement 33'', the tube 65 having the telescopically extendable column 63 is disposed not rigidly, but pivotably at 71, on the back of the chair frame. A latch mechanism, not shown but similar to that of FIG. 6, enables locking of the column 63 in various pivoted positions. In order to release the column once again, it is sufficient to pull on the knob 73 and thus release the latch. Instead of a pivotable connection at 71, such a connection could also be provided at the front of the frame 11. Otherwise the adjustment means 33'' is embodied identically to that of FIGS. 7 and 8, so that it need not be described in detail again here.

We claim:

1. Hand grip controlled raising chair having a frame (11) having essentially parallel frame elements;

means (25) for maintaining said frame elements in selectively spaced positions, including a predetermined extended spacing;

a seat (17) located between the frame elements when the frame elements are located in said predetermined extended spacing and movable between an essentially horizontal, seating position and an essentially vertical, or raised position;

force applying means (27) for applying a raising force when the seat is moved between seating and raised position and for counteracting and supporting, at least in part, the weight of a user when the seat is moved between raised and seating position;

at least one hand grip (35) adapted for supporting a hand of the user to permit the user to brace her/himself upon transition between seated and erect position, and thereby assist the force of the force applying means (27);

and adjustment means (33) connecting the at least one hand grip to one of the frame elements wherein, in accordance with the invention the adjustment means (33) connecting the at least one hand grip to one of the frame elements comprises a length-adjustable support element to permit the level of the position of the hand grip above a support surface for the raising chair to follow with the change in level of the user's hand upon transition between seated and erect position and to permit the user to brace her/himself on the hand grip regardless of the position of the user before, during and after said transition between seated and erect position.

2. Chair according to claim 1, wherein the adjustment means (33) is length-adjustable for placement in a position in which said support element and the hand grips are located at a level only up to about the level of the seat (17) when the seat is in seating position, to provide for laterally clear space and permit lateral transfer movement of a user from the seat.

3. Chair according to claim 1, wherein the adjustment means is embodied by a support arm (37), which carries the hand grip (35), is pivotably connected to the frame (11) and can be locked in positions at various levels.

4. Chair according to claim 3, wherein the support arm (37) can be lowered into a position at or below the level of the seat (17), on which level the seat (17) is located in the seating position.

5. Chair according to claim 3, wherein the support arm (37) is pivotably connected to the front of the frame (11).

6. Chair according to claim 5, wherein the seat (17) is pivotably connected to the frame;

and the support arm (37) has the same axis of rotation (39) as the seat (17).

7. Chair according to claim 3, wherein the support arm is pivotably connected to the back of the frame (11).

8. Chair according to claim 4, wherein a locking lever (41) is pivotably connected to the support arm (37) spaced apart from the pivot point (39) of the support arm;

and the locking lever (41) has a multiplicity of locking positions (45), which can be engaged by a locking element (47) disposed in the frame.

9. Chair according to claim 8, wherein the locking lever (41) is doubled-armed, one arm of which has the locking positions (45) and the other arm has a hand grip (49) for effecting unlocking.

10. Chair according to claim 4, wherein the at least one hand grip (35) is pivotable about a predetermined range.

11. Chair according to claim 10, wherein the support arm (37) comprises a tubular element and the hand grip (35) has an extension (38), which protrudes engagingly into the free end of the tubular element (37) and is rotatable therein about a predetermined range.

12. Chair according to claim 4, wherein the support arm (37) has a locking latch (57), which normally engages a ratchet wheel (55) or ratchet wheel segment firmly disposed on the frame (11), but can be manually released.

13. Chair according to claim 1, wherein the adjustment means (33) is embodied by a telescopically extendable column (63) supported on the frame (11).

14. Chair according to claim 13, wherein the column is pivotable and can be locked in various positions.

15. Chair according to claim 14, wherein the pivot point for the pivotable column is located adjacent an end portion of the frame.

16. Chair according to claim 1, wherein a hand grip (35) is provided on each side of the seat (17).

17. Chair according to claim 1, wherein the force applying means are lockable in selected positions, and including an actuating element (51) for releasing a locking device (53) for the seat (17), the actuating element being located in an area of the hand grip (35) within reach of the user's fingers.

18. Chair according to claim 1, wherein the hand grip apparatus includes a hand grip (35), which is disposed on the end portion of a hand grip adjustment means (33) supported on the frame (11), the adjustment means enabling a user controlled change in the position of the hand grip between an initial position laterally beside the seat surface, for when the user is seated, and an erecting and support position corresponding to an upright position of the user, and wherein an actuating element (51) for blocking (53) the force applying means (27) for erecting the user is provided on the hand grip (35) in an area reachable by the user's fingers.

19. Chair according to claim 18, having one hand grip apparatus on both sides of the seat (17), wherein the at least one hand grip adjustment means (33) has a support arm (37), pivotably supported on each of the two sides of the seat surface in the area of its pivotable connection with the frame, the support arm (37) being located, in the initial, seating position approximately in the same plane as the seat surface or somewhat below this plane and carrying the hand grip (35) on its end opposite the pivotable connection, the hand grip being disposed on a hand grip support which initially, in the seating position, is transversely offstanding from the support arm end in the direction of the backrest (19) and then is bent back in the direction of the pivotable connection of the support arm, and the adjustment means (33) further has a locking strap (41) provided between the support arm (37) and the frame (11), the strap being supported at one end on a support arm portion located between the pivotable connection and the end of the support arm nearer the hand grip and such that it is tiltable about a trunnion (40) to a limited extent, in such a manner that one end portion (49) of the locking strap (41) embodies an actuating lever arm (51) offstanding from the support arm in the direction of the user and the strap being continued on the other end as a strap portion provided with a plurality of locking protrusions (45) which upon pivoting upward of the support arm (37) out of an initial seating position lock successively in a trunnion (47) secured to the frame (11).

20. Chair according to claim 19, wherein the hand grip support with its associated support arm end can be shifted via a pivot connections (50) between a position approximately in alignment with the longitudinal axis of the support arm (37) and a position which is pivoted outward with respect to the frame (11), at an acute angle with respect to said longitudinal axis.

21. Chair according to claim 1, having one hand grip apparatus on both sides of the seat (17), wherein the at least one hand grip adjustment means (33) has a support arm (37), pivotably supported on each of the two sides of the seat surface in the area of its pivotable connection with the frame, the support arm (37) being located, in the initial, seating position approximately in the same plane as the seat surface or somewhat below this plane and carrying the hand grip (35) on its end opposite the pivotable connection, the hand grip being disposed on a hand grip support which initially, in the seating position, is transversely offstanding from the support arm end in the direction of a backrest (19) and then is bent back in the direction of the pivotable connection of the support arm, and the adjustment means (33) further has a ratchet trunnion (55) secured on the frame in the pivot bearing center of the support arm (37), the trunnion having ratchet teeth on its circumference engageable by a locking latch (57), which is supported in a pre-stressed manner in the associated hollow end portion of the support end against the ratchet teeth by means of a spring (59) and has a hand grip (61) protruding laterally out of this end portion, the connection embodied via the ratchet trunnion (55) and the locking latch (57) blocking any pivoting of the support arm (37) into its initial seating position.

22. Chair according to claim 1 having one hand grip apparatus on each of both sides of the seat (17), wherein the at least one hand grip adjustment means (33) on both sides of the seating surface on the frame (11) has a respective sliding guide (65) with a hand grip rod (63) displaceable relative to the guide (65), the rod (63) having on its end portion facing the seat (17) the hand grip (35) bent in the manner of a crook with respect to the rod, and between the hand grip rod (63) and its sliding guide (65), a blocking device (67) actuatable in the vicinity near the hand grip is provided, which prevents unintentional shifting of the at least one hand grip rod (63) relative to the sliding guide (65).

23. Chair according to claim 22, wherein the hand grip rod (63) is displaceably supported in a sliding guide (65) embodied as an inner wall of a tube, further wherein one circular-annular recess (69, 71) which enlarges the inner wall diameter is embodied in the inner wall of the tube at each of the two end portions of the rod displacement path, further wherein the hand grip rod (63) bears on its end portion a flexible disk spring (67) pre-stressed to bulge or bow toward the inner wall of the tube, the circumferential rim of which spreads apart at the inner wall of the tube and which as a result, as long as a displacement occurs between the hand grip rod and the inner wall of the tube within the mutual spacing, corresponding approximately to the displacement distance, of the circular-annular recesses (69, 71), permits this displacement only in one displacement direction at a time, and further wherein after a shift of the disk spring (67) into one of the recesses (69, 71), upon an ensuing renewed movement of the spring disk into the inner wall area between the recesses, a reversal of the bulging or bowing of the disk spring (67) takes place, which causes a reversal of the arresting action performed by this spring disk.

24. Chair according to claim 22, wherein the sliding guide (65) for the hand grip rod (63) is pivotably supported on the end portion of the frame (11) to the rear, oriented toward the backrest (19) or to the front, oriented toward the pivotable connection of the seat surface, and the pivoting of the sliding guide (65) can be arrested in various pivoted positions via a user actuatable latch lock embodied in the pivotable connection area.

25. Chair according to claim 18, wherein the chair is a collapsible raising wheelchair, which is pivotably connected to the frame on the portion of its seat surface near the back of the user's knees and has a backrest (19) pivotable with respect to the seat surface, so that the seat can be shifted relative to the frame between a seating position and an erecting position, further wherein the force applying means (27) for erecting the user is provided between the frame and the seat, and a locking device (53) for the force applying means (27) is actuatable by the user and prestresses the user with a predetermined force into her or his upright position, so that with the hand grip arrangement graspable by the user, the user's weight acting upon the seat is reduced during the process of raising her or him upright.

* * * * *